US008262769B2

(12) United States Patent
Narieda et al.

(10) Patent No.: US 8,262,769 B2
(45) Date of Patent: Sep. 11, 2012

(54) METHOD OF DETINNING SN PLATING LAYER ON CU-BASED MATERIAL

(75) Inventors: Hiroto Narieda, Tokyo (JP); Yuta Sonoda, Tokyo (JP); Masaaki Izaki, Tokyo (JP)

(73) Assignee: Dowa Metaltech Co., Ltd, Tokyo (JP)

( * ) Notice: Subject to any disclaimer, the term of this patent is extended or adjusted under 35 U.S.C. 154(b) by 89 days.

(21) Appl. No.: 12/926,807

(22) Filed: Dec. 10, 2010

(65) Prior Publication Data

US 2011/0138966 A1 Jun. 16, 2011

(30) Foreign Application Priority Data

Dec. 15, 2009 (JP) ..... 2009-284302

(51) Int. Cl.
*C23G 1/20* (2006.01)
*C23F 4/00* (2006.01)
*C23F 1/34* (2006.01)

(52) U.S. Cl. ..... 75/715; 75/726; 134/2; 216/105

(58) Field of Classification Search ..... 75/726, 75/715; 134/2; 216/105
See application file for complete search history.

(56) References Cited

U.S. PATENT DOCUMENTS

| | | | | | |
|---|---|---|---|---|---|
| 2,891,881 | A | * | 6/1959 | Jaffe | 75/401 |
| 4,687,545 | A | * | 8/1987 | Williams et al. | 216/107 |
| 5,281,304 | A | * | 1/1994 | Kadomura | 438/703 |
| 5,993,559 | A | * | 11/1999 | Singer et al. | 134/2 |
| 2008/0073614 | A1 | * | 3/2008 | Akiyama et al. | 252/79.3 |

FOREIGN PATENT DOCUMENTS

| | | | | |
|---|---|---|---|---|
| JP | 58-087275 | A | | 5/1983 |
| JP | 63020489 | A | * | 1/1988 |
| JP | 2000-226214 | A | | 8/2000 |

* cited by examiner

*Primary Examiner* — George Wyszomierski
*Assistant Examiner* — Tima M McGuthry Banks
(74) *Attorney, Agent, or Firm* — Rader, Fishman & Grauer PLLC

(57) ABSTRACT

A Cu-based material 5 is immersed into an alkali hydroxide solution with a concentration of 3.0 to 37.5 mass % and a $H_2O_2$ solution with a concentration of 3.0 to 50.0 mass % is added in the alkali hydroxide solution, a temperature of the alkali hydroxide solution when the Cu-based material is immersed ranges from 60 to 105° C., a ratio A/B between a mol number A of alkali hydroxide in the alkali hydroxide solution and a mol number B of $H_2O_2$ in the $H_2O_2$ solution is 10 or more, and where a mol number of Sn in the Sn layer is C and a mol number of Sn in the CuSn layer is D, $B \geqq C \times 2 + D \times 6$.

10 Claims, 1 Drawing Sheet

METHOD OF DETINNING SN PLATING LAYER ON CU-BASED MATERIAL

BACKGROUND OF THE INVENTION

1. Field of the Invention

The present invention relates to a method of detinning a Sn layer and/or a CuSn layer of a Sn plating layer formed on a Cu-based material to recycle the Cu-based material.

2. Description of the Related Art

A Cu-based material including a copper-based alloy containing one or more of elements of Fe, Ni, Si, Sn, P, Mg, Zr, Cr, Ti, Al, Ag and so on in a range of several hundreds mass ppm to 30 mass %, in addition to pure copper, brass, or phosphor bronze is made from an ingot via processes of rolling, annealing and so on and finished as a bar rod or a wire rod with a plate thickness of 0.1 to 4.0 mm, and then widely used for current-carrying parts such as terminal, bus bar, spring and the like for vehicle, for household appliance or for industrial instrument. Such a Cu-based material is generally used after it is plated with Sn that is relatively inexpensive among plating metals at a thickness of 0.5 to 5.0 μm in order to secure contact reliability at application of current and corrosion resistance. Due to reflow treatment or aging of the Sn plating, a CuSn diffusion layer mainly composed of intermetallic compound such as $Cu_6Sn_5$, $Cu_3Sn$ or the like is formed between the Cu-based material and the Sn plating or between a Cu base plating and the Sn plating when the Cu base plating has been applied between the Cu-based material and the Sn plating, and the thickness of the CuSn diffusion layer is about 0.2 to 2.0 μm. Further, the layer of Sn which has not been consumed for the formation of the CuSn diffusion layer but remains on the uppermost surface side of the Sn plating is called a Sn layer.

Until the Cu-based material such as a plate material or the like to which Sn plating has been applied is formed into a product of a current-carrying part, slitting process, pressing process or the like is generally performed after the Sn plating, and scraps are generated during the processing. If the scraps are molten as they are as a raw material, the molten material contains much Sn component corresponding to the plated Sn and cannot be reused as a raw material of the Cu-based material that is the original material. Therefore, to reuse the original material, detinning the plated Sn is conceivable.

Conventionally proposed methods as a method of detinning the Sn plating on the Cu-based material are electrolysis in sodium hydroxide and immersion into sulfuric acid or nitric acid containing Cu ions as disclosed in Japanese Laid-open Patent Publication No. S58-87275.

Further, Japanese Laid-open Patent Publication No. 2000-226214 discloses, as a method of dissolving Sn in a method of producing a high-purity alkali stannate compound, a method of dissolving Sn while dripping a hydrogen peroxide solution as a reaction accelerator into an alkali hydroxide solution.

SUMMARY OF THE INVENTION

However, when the Sn plating is electrolyzed in the sodium hydroxide solution, it is very difficult to make the current density uniform on all of the surfaces of the Cu-based materials with the Sn plating which are small and overlapping one another such as scraps generated after the slitting process and pressing process. Therefore, dissolution extends to the material at a portion where the current concentrates, causing generation of a Cu-based sludge and resulting in waste when recycling the Cu-based material as a raw material. On the other hand, if the electrolysis is finished at the moment when the detinning of the portion where the current concentrates ends, a residual of Sn occurs at a portion where the current density is low, causing a problem of occurrence of component failure when recycling the Cu-based material as a raw material.

The immersion into sulfuric acid containing Cu ions disclosed in Japanese Laid-open Patent Publication No. 58-87275 has an advantage that the Cu-based material is not corroded after the detinning of Sn because the Sn plating is detinned by substitution reaction. However, the scraps to which machining oil or the like has adhered due to, for example, pressing process may be the ones that very strongly contact to one another due to the pressure of the press and oil when they pass through the mold of the press. In such a case, unless degreasing is performed, the substitution reaction is suppressed and Sn remains to lead to component failure. Therefore, a degreasing step as pre-treatment is indispensable, and an increase in cost and a decrease in productivity due to the increase in the number of steps and the increase in chemical cost are unavoidable.

Further, when detinning is performed in the sulfuric solution, S (sulfur) component in the sulfuric acid adheres to the surface after the detinning. If the Cu-based material is molten and casted as it is to be recycled as a raw material, many adverse effects that S segregated in the grain boundary of the Cu-based material to lead to cracks in the cast and the subsequent hot rolling. For this reason, the rinse process after detinning needs to be sufficiently performed. Further, in the Cu substitution reaction, since the substitution reaction slows down when the Sn ion concentration in the solution increases, an operation for removing the Sn ions from the solution becomes necessary and an increase in cost is unavoidable.

The Sn dissolving method disclosed in Japanese Laid-open Patent Publication No. 2000-226214 is intended for extracting Sn as a high-purity alkali stannate, and therefore focuses attention only on dissolution of Sn element, but does not take account of the CuSn layer that is more difficult to dissolve than Sn. More specifically, it was found by the study of the inventors that it is possible to dissolve the Sn element but it is very difficult to completely detin also the CuSn layer by the dripping method of a hydrogen peroxide solution disclosed in Japanese Laid-open Patent Publication No. 2000-226214. Further, recycling the material of the Cu-based material on which a Sn plating containing the CuSn layer has been applied as a raw material is not described. Further, according to the embodiment of Japanese Laid-open Patent Publication No. 2000-226214, since the amount of hydrogen peroxide solution is very large with respect to the amount of the initial alkaline solution and the alkali concentration after finish of dripping will decrease, it is difficult to continuously dissolve Sn using the solution without taking any measure such as condensation or the like.

An object of the present invention is to provide a method of detinning a Sn plating layer on a Cu-based material capable of easily detinning a Sn layer and a CuSn layer and the like on the Cu-based material with the Sn plating layer containing the Sn layer and/or the CuSn layer even when machining oil or the like has adhered thereto, and recycling the Cu-based material as a raw material.

To achieve the above object, the present invention is a method of detinning a Sn plating layer on a Cu-based material for recycling the Cu-based material on which the Sn plating layer including a Sn layer and/or a CuSn layer is formed, the method including: immersing the Cu-based material into an alkali hydroxide solution with a concentration of 3.0 to 37.5 mass % and adding a $H_2O_2$ solution with a concentration of 3.0 to 50.0 mass % in the alkali hydroxide solution, wherein a temperature of the alkali hydroxide solution when the Cu-based material is immersed ranges from 60 to 105° C., wherein a ratio A/B between a mol number A of alkali hydroxide in the alkali hydroxide solution and a mol number B of $H_2O_2$ in the $H_2O_2$ solution is 10 or more, and wherein where a mol number of Sn in the Sn layer is C and a mol number of Sn in the CuSn layer is D, $B \geqq C \times 2 + D \times 6$.

According to the present invention, it is possible to easily detin the Sn layer and the CuSn layer of the Sn plating layer on the Cu-based material having the CuSn diffusion layer to which oil such as machining oil or the like has adhered, and recycle the Cu-based material as a raw material.

DETAILED DESCRIPTION OF THE INVENTION

Hereinafter, an embodiment of the present invention will be described.

The present invention immerses a Cu-based material having a Sn plating layer including a CuSn layer made of an intermetallic compound such as $Cu_6Sn_5$, $Cu_3Sn$ or the like formed thereon into an alkali hydroxide solution made by dissolving NaOH or KOH or the like and adds a $H_2O_2$ solution in the alkali hydroxide solution to thereby detin the Sn plating layer. Note that the detinning includes removal of the CuSn layer in this specification.

The Sn plating layer refers to the layer including a Sn layer and/or a CuSn layer. Typical Sn plating layer is the one made by applying Sn plating to the surface of the Cu-based material or the one made by applying Cu plating to the surface of the Cu-based material as a base layer and then applying Sn plating thereto. Another one is composed of a Sn layer and a CuSn layer made by performing heat treatment such as reflow treatment after the Sn plating to form the CuSn layer (a CuSn diffusion layer). Note that depending on heat treatment conditions of the heat treatment such as the reflow treatment, the Sn layer may disappear in some cases so that the Sn plating layer is composed only of the CuSn layer. The CuSn layer refers to a layer made of the intermetallic compound of Cu and Sn and/or Cu or Sn solid-dissolved in a parent phase or the like. The Sn layer in the present invention refers to a Sn plating that has not been subjected to heat treatment as described above or a remaining Sn layer that did not become the CuSn diffusion layer after performing heat treatment such as reflow treatment or the like after Sn plating. The Sn layer has a Sn content of about 90 mass % or more. In addition, the Sn plating layer may be formed by a so-called hot-dip Sn plating (Hot Dip) of immersing the Cu-based material in the molten Sn to form a Sn layer and a CuSn layer (a CuSn diffusion layer).

Figure 1:
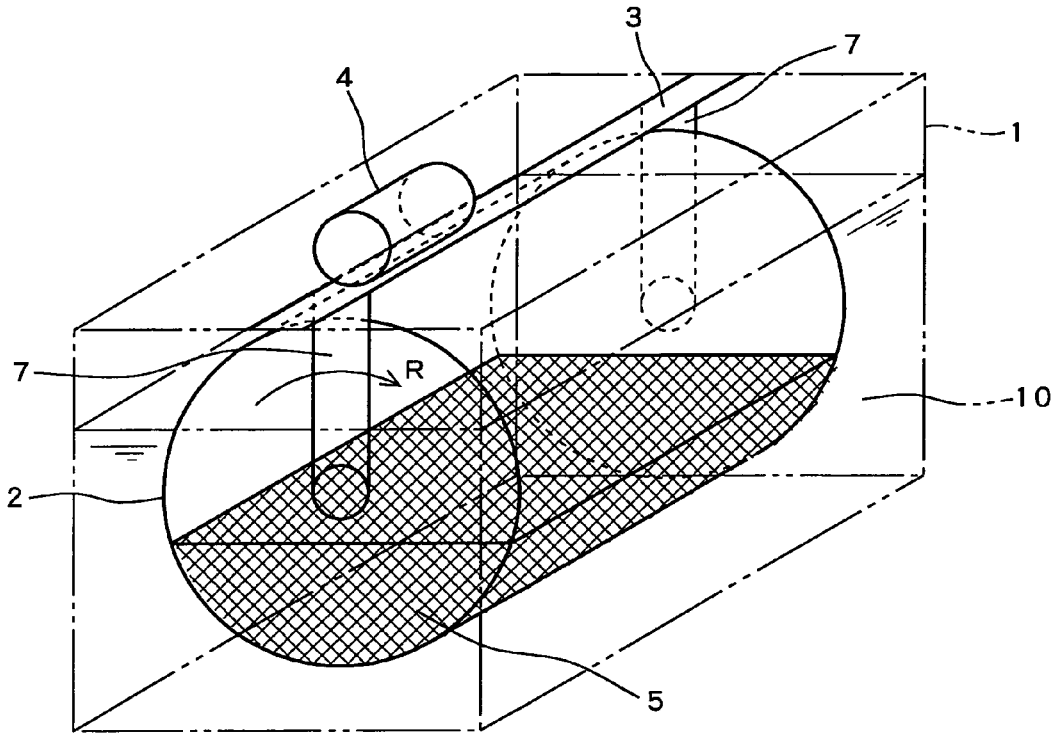
FIG. 1 is a schematic perspective view showing one example of an apparatus for implementing the present invention.
Figure 2:
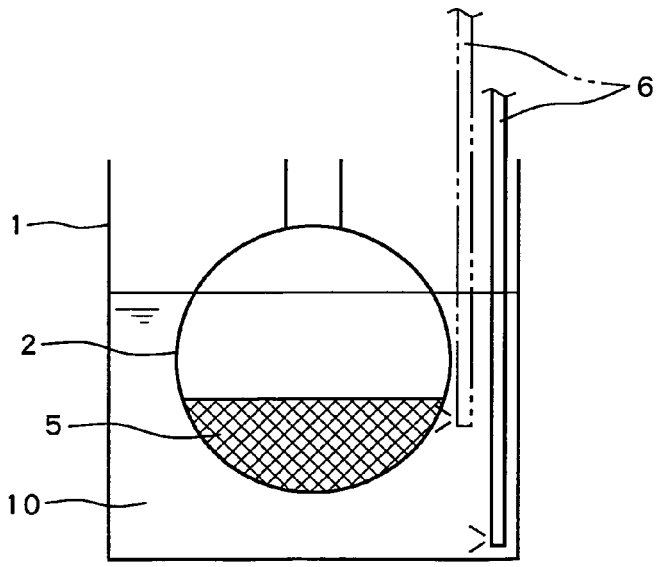
FIG. 2 is a view explaining a method of adding a $H_2O_2$ solution in FIG. 1.

FIG. 1 and FIG. 2 show the outline of an apparatus implementing a method of detinning a Sn plating layer of the present invention. As shown in FIG. 1, a cylindrical barrel 2 is installed in a bath 1, for example, in a rectangular parallelepiped shape storing an alkali hydroxide solution 10. The barrel 2 is formed, for example, of a wire mesh of stainless steel and attached to a barrel fixing part 3 at the top of the bath 1 via a supporting member 7. By drive of a barrel motor 4, a rotational force is transmitted to the barrel 2 via a not-shown belt or the like, and the barrel 2 rotates around a center axis of the barrel 2 (for example, in an R-direction).

A processing object 5 that is the Cu-based material such as a scrap or the like after cutting process or pressing process on which the Sn plating layer is formed is housed in a lower portion of the barrel 2 as shown in FIG. 1 and FIG. 2, and the barrel 2 is immersed together with the processing object 5 into the alkali hydroxide solution 10. Into the alkali hydroxide solution 10, a $H_2O_2$ solution is added. When the $H_2O_2$ is dripped from the outside of the alkali hydroxide solution 10, for example, from above as in the prior art, the detinning speed of the Sn plating layer is slow, and especially when the CuSn layer is included in the Sn plating layer, it is very difficult to remove the CuSn layer even if spending a lot of time. As a result of repeated tests by the inventors, it was found that addition of the $H_2O_2$ solution in the alkali hydroxide solution 10 makes it possible to sufficiently increase the detinning speed of the Sn plating layer and also remove the CuSn layer at a sufficient speed. For example, as shown in FIG. 2, the tip of a $H_2O_2$ supply pipe 6 is inserted down to near the bottom portion of the bath 1 to supply the $H_2O_2$ solution from near the bottom portion of the alkali hydroxide solution 10. Alternatively, the tip of the $H_2O_2$ supply pipe 6 may be inserted to an arbitrary place in the alkali hydroxide solution 10 inside the barrel 2 to supply the $H_2O_2$ solution. Then, by rotating the barrel 2 to stir the alkali hydroxide solution 10 in which the $H_2O_2$ solution is mixed, the Sn layer and the CuSn layer on the processing object 5 can be effectively detinned.

Note that when the $H_2O_2$ solution was actually dripped from above the alkali hydroxide solution 10 as described in Japanese Laid-open Patent Publication No. 2000-226214, especially the CuSn layer dissolved very slowly and substantially could not be detinned. A conceivable reason for this is that decomposition reaction of $H_2O_2$ starts at the moment when the $H_2O_2$ solution touches the alkali hydroxide solution 10, and oxygen produced by the reaction is likely to dissipate into the atmosphere, so that the oxygen does not sufficiently dissolve into the alkali hydroxide solution 10 to fail to achieve enough detinning effect.

In the present invention, the concentration of alkali hydroxide in the alkali hydroxide solution is set to, by mass %, a range of 3.0 to 37.5%, preferably, 3.5 to 30.0%. When the concentration is less than 3.0% or more than 37.5%, the detinning effect of the Sn plating layer is decreased. When the concentration is high, the detinning effect is considered to decrease because the decomposition of the added $H_2O_2$ increases. Specifically, to detin the CuSn diffusion layer, the concentration of alkali hydroxide more preferably ranges from 5.0 to 25.0%.

Where the mol number of alkali hydroxide in the alkali hydroxide solution is A and the mol number of $H_2O_2$ in the $H_2O_2$ solution is B, the mol ratio A/B is set to 10 or more. When A/B is less than 10, the cost is very high and the detinning effect of the Sn plating layer is not enough. Further, where the mol number of Sn in the Sn layer on the Cu-based material to which Sn plating has been applied is C and the mol number of Sn in the CuSn layer is D, $B \geqq C \times 2 + D \times 6$. The reason why the mol number B of $H_2O_2$ is required to be $B \geqq C \times 2 + D \times 6$ is considered to have a relation with the intermetallic compound of CuSn, and when $B < C \times 2 + D \times 6$, the CuSn layer does not sufficiently dissolve. Further, the ratio A/(C+D) between the mol number A of alkali hydroxide and the mol number (C+D) of Sn in the Sn layer and Sn in the CuSn layer is preferably 50 or more, and more preferably, 100 or more.

The temperature of the alkali hydroxide solution is set to a range from 60 to 105° C., and preferably, a range from 70 to 100° C. when the Cu-based material is immersed therein. When the temperature is lower than 60° C., the effect of detinning the Sn plating layer is low (the detinning speed is slow), whereas when the temperature exceeds 105° C., bumping may occur when $H_2O_2$ is inputted thereinto, and therefore the temperature is preferably set to 100° C. or lower for safety.

The alkaline component in the alkali hydroxide solution absorbs carbon dioxide in the atmosphere and partially substitutes for alkaline carbonate such as $Na_2CO_3$ or the like, and it was found that an increase in the amount of alkaline carbonate decreases the detinning reaction. Therefore, the concentration of alkaline carbonate is set to 20 mass % or lower, and preferably, 15 mass % or lower. It is only necessary to add the alkali hydroxide solution in a manner that the concentration of alkaline carbonate does not exceeds the aforementioned concentration.

The concentration of $H_2O_2$ in the $H_2O_2$ solution to be added is set to, by mass, 3.0 to 50.0%, and preferably, 3 to 35%, and the $H_2O_2$ solution is continuously added into the alkali hydroxide solution. When the concentration is below 3.0%, the amount of the $H_2O_2$ solution satisfying the required mol number B of $H_2O_2$ increases to increase the solution mass (volume) increase rate, with the result that the alkali concentration in the alkali hydroxide solution greatly decreases. Therefore, when detinning is continuously performed, it is necessary to drain and discard the thinned solution and replenish alkali hydroxide, leading to disadvantage in cost. When the concentration exceeds 50%, local reaction is likely to occur and consume $H_2O_2$ more than necessary, leading to disadvantage in cost. The concentration more preferably ranges from 5 mass % to 35 mass %. Further, the time of adding the $H_2O_2$ solution preferably ranges from 5 to 60 minutes, and, the total addition amount is preferably 10% or lower of the mass of the alkali hydroxide solution, and more preferably, 5% or lower. When the required amount is inputted in a time of adding the $H_2O_2$ solution shorter than 5 minutes, more $H_2O_2$ reacts with alkali to decompose than $H_2O_2$ consumed to detin the Sn plating layer. Further, when the time of adding the $H_2O_2$ solution exceeds 60 minutes, the productivity decreases and detinning of the Sn plating layer can be performed within the range of the present invention.

The Cu-based material may not be drawn up soon after the required amount of $H_2O_2$ solution is inputted, but may be kept immersed in the solution. In this case, the keeping time is preferably within 60 minutes from the viewpoint of productivity.

By adding the $H_2O_2$ solution in the alkaline solution with the alkali and $H_2O_2$ set to the predetermined mol numbers as described above, the Sn layer and the CuSn layer can be easily detinned. In addition, the solution amount hardly increases and the detinning ability does not deteriorate, so that the Sn plating layer can be continuously detinned. Furthermore, since the detinning of Sn is performed utilizing the oxidation and reduction power of the solution into which the Cu-based material is immersed, the Sn component on the surface like small scraps that could not be uniformly detinned in the conventional electrolytic method can be easily and uniformly detinned by stirring using, for example, the barrel 2 shown in FIG. 1 or a stirring means such as rotation of a stirring blade or the like or by installing a circulation pump or the like and stirring the solution. Further, by immersing into the alkaline solution, the Sn layer and the CuSn layer can be detinned while degreasing the Cu-based material to which machining oil has adhered due to the cutting process (slitting process) or the pressing process.

Further, after the predetermined $H_2O_2$ solution is added, the addition of the $H_2O_2$ solution is stopped and the Cu-based material is immersed and kept in the solution as it is, whereby Cu ions generated by dissolving the CuSn layer are reduced and precipitated on the surface of the Cu-based material, so that it is possible to prevent waste leakage of Cu component and effectively reuse the Cu component.

According to the present invention, since the alkali hydroxide solution having the degreasing action is used, the Sn plating layer can be detinned even from the Cu-based material to which machining oil has adhered due to the slitting process or the pressing process performed to form a current-carrying product at the same time with degreasing the Cu-based material as described above, without performing a degreasing step as pre-treatment. Note that to efficiently perform detinning in the method of detinning the Sn plating layer of the present invention, the thickness of the Sn plating is preferably 5 μm or less, and the thickness of the CuSn layer is preferably 2 μm or less.

A Preferred embodiment of the present invention has been described above with reference to the accompanying drawings, but the present invention is not limited to the embodiment. It should be understood that various changes and modifications are readily apparent to those skilled in the art within the scope of the technical spirit as set forth in claims, and those should also be covered by the technical scope of the present invention. For example, the apparatus shown in FIG. 1 and FIG. 2 is one example, and the stirring method of the alkali hydroxide solution is not limited to the barrel, and the supply unit of $H_2O_2$ is not limited to the supply pipe in FIG. 2.

Example 1

By the apparatus shown in FIG. 1, a test of detinning the Sn plating layer from the Cu-based material having the Sn plating layer was performed. The detinning test of the Sn plating layer was performed by applying the detinning method of the present invention to 16 kinds of present invention examples 1 to 16 which are Cu-based materials having the Sn plating thickness ranging from 0.5 to 4 μm and the plate thickness ranging from 0.25 to 0.8 mm. The alkaline solution was a KOH solution only for the present invention example 16 and a NaOH solution for the other examples, and the alkali hydroxide concentration was set to range from 3.0 to 37.5% by mass and the temperature was set to range from 60 to 100° C. for each example. Further, the concentration of the $H_2O_2$ solution (hydrogen peroxide solution) was set to range from 3 to 35% by mass for each example, and added near the bottom of the alkaline solution. Further, after the addition of the $H_2O_2$ solution was stopped, the Cu-based material was kept in the alkaline solution for 15 minutes for the present invention example 6 and for 10 minutes for the present invention example 9, and the Cu-based materials were taken out of the alkaline solution soon after the addition of the $H_2O_2$ solution was stopped for the other examples.

For each of the present invention examples 1 to 16, the required mol number of the mol number B of $H_2O_2$ in the $H_2O_2$ solution ($B \geqq C \times 2 + D \times 6$) was obtained from the mol number C of Sn in the Sn layer of the Sn plating layer and the mol number D of Sn in the CuSn diffusion layer, and the mol number of $H_2O_2$ in the $H_2O_2$ solution was set to be the obtained mol number or more. Further, the mol number of the alkaline solution was set so that the ratio A/B between the mol number A of the alkali hydroxide in the alkali hydroxide solution and the mol number B of $H_2O_2$ in the $H_2O_2$ solution to be added was 10 or more.

Further, the circumferential speed of the barrel was set to range from 2.6 to 15.5 m/min.

In the present invention examples, the detinning test was performed on the Sn plating layer formed by applying Sn plating on the Cu-based material and performing reflow treatment on it. Here, the value of Sn thickness of the reflow-treated Sn plating layer measured by a fluorescent X-ray film thickness meter was regarded as the thickness of the Sn plating applied on the Cu-based material. As the fluorescent X-ray film thickness meter, SFT3300 manufactured by Seiko Instruments was used. Before the Sn plating layer was measured by the fluorescent X-ray film thickness meter, a sample of Sn with a standard thickness for the fluorescent X-ray film thickness meter was mounted on the Cu-based material, and calibration of the device was carried out. Further, the Sn thickness of the surface of the sample after the detinning test was carried out for the aforementioned Sn plating layer was similarly measured by the fluorescent X-ray film thickness meter, and the degree of detinning of the Sn plating layer was evaluated using the measured value as the residual thickness of Sn component. The thickness of the Sn layer (a pure Sn layer) of the Sn plating layer was measured by a coulometric film thickness meter (TH11 manufactured by Chuo Seisakusho).

The mol number of all Sn contained in the Sn plating layer was calculated from the plate thickness and the mass of the Cu-based material and the thickness of the aforementioned Sn plating layer. The mol number of Sn in the Sn layer was similarly calculated from the thickness of the aforementioned Sn layer. The mol number of Sn in the CuSn layer is what is obtained by subtracting the mol number of Sn in the Sn layer from the mol number of all Sn in the aforementioned Sn plating layer, and thus was calculated by subtracting the mol number of Sn in the aforementioned Sn layer from the mol number of all Sn in the aforementioned Sn plating layer. 50 pieces of Cu-based material after the detinning test were extracted and the residual thicknesses of Sn components after the detinning tests were measured by the fluorescent X-ray film thickness meter, and the average of the results was shown as the residual thickness of Sn component after the detinning test.

On the other hand, as comparative examples, 7 kinds of detinning tests of immersing the similar Cu-based materials having a Sn plating thickness of 1 μm and a plate thickness of 0.25 mm into a NaOH solution were carried out. Comparative examples includes the one in which the $H_2O_2$ solution was dripped from above the alkaline solution (Comparative Example 1), the one in which the concentration of the alkaline solution was too high (Comparative Example 2), the one in which A/B was less than 10 (Comparative Example 3), the one in which the temperature of the alkaline solution was lower than 60° C. (Comparative Example 4), the one in which the concentration of the $H_2O_2$ solution was less than 3 mass % and the addition amount of the $H_2O_2$ solution exceeded 10 mass % (Comparative Example 5), the one in which the concentration of the alkaline solution was less than 3 mass % and A/B was lower than 10 (Comparative Example 6), and the one in which the mol number B of $H_2O_2$ in the $H_2O_2$ solution was the required amount or less (Comparative Example 7).

The conditions of the Cu-based materials, alkaline solutions, and the $H_2O_2$ solutions and the results of the detinning tests of the above present invention examples and comparative examples are shown in Table 1 and Table 2 respectively. Note that in the material kind column in Table 1, the CDA numbers are shown, and CD2600 is brass, C1020 is oxygen-free copper, and C19025 is a copper alloy composed of Ni: 1.0 mass %, Sn: 0.90 mass %, P: 0.05 mass %, and the balance Cu. As scrap materials of the Cu-based materials, pressed scraps to which machining oil adhered were taken as samples of all of the examples and comparative examples. Further, in the comparative examples in Table 2, under line was given to the conditions out of the present invention.

[Table 1]

[Table 2]

When recycling the Cu-based materials, the target value of the residual thickness of Sn component is 0.1 μm or less, and preferably, 0.05 μm or less. As shown in Table 1, the present invention examples exhibited excellent results in which the residual thickness was 0.00 to 0.06 μm (in the case of the NaOH solution, 0.04 μm or less) irrespective of the condition of the Cu-base material. In all of the comparative examples except the comparative example 5, the residual thickness exceeded 0.1 μm and the Sn layer, especially the CuSn layer could not be sufficiently detinned.

In the comparative example 5, the residual thickness of Sn component was 0.09 μm and the Sn plating layer could be dissolved (detinned), but the solution amount of the treatment solution increased by 12.5 mass %. To perform continuous Sn plating detinning treatment, a treatment (process) of reducing the solution by evaporation, condensation or the like to adjust the concentration of chemical was required, and therefore the comparative example 5 was not appropriate as the method of detinning the Sn plating layer on the Cu-based material because additional labor and cost were required.

Example 2

Under the same conditions as those of the present invention example 1 of Example 1, a test in which the same alkaline solution was used repeatedly 10 times was carried out.

Even when the same alkaline solution was used repeatedly 10 times, the excellent result that the residual thickness of Sn component was 0.01 μm was obtained.

Example 3

Sn detinning test was carried out under the same conditions as those of the present invention example 1 of Example 1 except that the solutions contained sodium carbonate added by 5, 10 and 20% by mass were used.

As a result, the residual thicknesses of Sn component were 0.01 μm when the sodium carbonate was added by 5, 10%, 0.04 μm when added by 15%, and 0.08 μm when added by 20%. The detinning ability decreased due to an increase in the amount of sodium carbonate, but there was no problem in addition up to 20%.

TABLE 1

| | | | range of present invention | present invention example | | | | | | | | |
|---|---|---|---|---|---|---|---|---|---|---|---|---|
| | | | | 1 | 2 | 3 | 4 | 5 | 6 | 7 | 8 | 9 |
| Cu-based material | material kind | | | C2600 | C2600 | C2600 | C1020 | C2600 | C2600 | C19025 | C2600 | C2600 |
| | volume density | $g/cm^3$ | | 1.2 | 1.2 | 1.2 | 1 | 1.5 | 1.2 | 2 | 0.5 | 0.8 |
| | plate thickness | mm | | 0.25 | 0.25 | 0.25 | 0.64 | 0.25 | 0.25 | 0.8 | 0.64 | 0.15 |
| | mass | g | | 2000 | 2000 | 2000 | 2000 | 2000 | 2000 | 4000 | 2000 | 2000 |

TABLE 1-continued

| | | | | | | | | | | | | |
|---|---|---|---|---|---|---|---|---|---|---|---|---|
| | Sn surface area | $dm^2$ | | 180 | 180 | 180 | 70 | 180 | 180 | 112 | 70 | 300 |
| | Sn plating thickness | μm | 5 or less | 1 | 1 | 1.3 | 0.8 | 1 | 1 | 0.5 | 4 | 1 |
| | Sn mass | g | | 13.1 | 13.1 | 17.1 | 4.1 | 13.1 | 13.1 | 4.1 | 20.5 | 21.9 |
| | Sn mol number | mol | | 0.11 | 0.11 | 0.14 | 0.03 | 0.11 | 0.11 | 0.03 | 0.17 | 0.18 |
| | pure Sn layer thickness | μm | | 0.75 | 0.75 | 1 | 0.5 | 0.75 | 0.75 | 0.2 | 3.5 | 0.75 |
| | C: Sn mol number in pure Sn layer | mol | | 0.08 | 0.08 | 0.11 | 0.02 | 0.08 | 0.08 | 0.01 | 0.15 | 0.14 |
| | D: Sn mol number in CuSn layer | mol | | 0.03 | 0.03 | 0.03 | 0.01 | 0.03 | 0.03 | 0.02 | 0.02 | 0.05 |
| | required $H_2O_2$ mol number | mol | C × 2 + D × 6 | 0.33 | 0.33 | 0.42 | 0.12 | 0.33 | 0.33 | 0.15 | 0.43 | 0.55 |
| alkali solution | kind | | | NaOH | NaOH | NaOH | NaOH | NaOH | NaOH | NaOH | NaOH | NaOH |
| | concentration | mass % | 3.0-37.5(3.5-30) | 15.0 | 37.5 | 10.0 | 20.0 | 30.0 | 30.0 | 5.0 | 20.0 | 20.0 |
| | solution mass | g | | 4800 | 4800 | 6200 | 1800 | 4800 | 4800 | 4800 | 4800 | 4800 |
| | A: alkali mol number | mol | | 18 | 45 | 15.5 | 9 | 36 | 36 | 6 | 24 | 24 |
| | temperature | ° C. | 60-105(70-100) | 90 | 80 | 100 | 90 | 70 | 60 | 80 | 90 | 80 |
| $H_2O_2$ solution | concentration | mass % | 3.0-50.0(3-35) | 20 | 20 | 35 | 20 | 35 | 20 | 20 | 20 | 10 |
| | solution amount | g | | 40 | 40 | 30 | 40 | 18 | 40 | 40 | 40 | 100 |
| | solution mass increase rate | % | (10 or less (5 or less)) | 0.8 | 0.8 | 0.5 | 2.2 | 0.4 | 0.8 | 0.8 | 0.8 | 2.1 |
| | $H_2O_2$ mass | g | | 8 | 8 | 10.5 | 8 | 6.3 | 8 | 8 | 8 | 10 |
| | B: $H_2O_2$ mol number | mol | ≧C × 2 + D × 6 | 0.44 | 0.44 | 0.58 | 0.44 | 0.35 | 0.44 | 0.44 | 0.44 | 0.56 |
| | addition position | | in solution | in solution | in solution | in solution | in solution | in solution | in solution | in solution | in solution | in solution |
| | addition speed | g/min | | 2.0 | 1.6 | 2.0 | 2.0 | 0.6 | 0.9 | 2.0 | 2.0 | 20.0 |
| | addition time | min | 5-60 | 20 | 25 | 15 | 20 | 30 | 45 | 20 | 20 | 5 |
| | holding time after addition | min | | 0 | 0 | 0 | 0 | 0 | 15 | 0 | 0 | 10 |
| mol ratio | alkali/Sn | | 50 or more | 163 | 407 | 108 | 260 | 326 | 326 | 174 | 139 | 130 |
| | A/B: alkali/$H_2O_2$ | | 10 or more | 40.5 | 101.3 | 26.6 | 20.3 | 102.9 | 81.0 | 13.5 | 54.0 | 43.2 |
| | $H_2O_2$/Sn | | | 4.0 | 4.0 | 4.1 | 12.9 | 3.2 | 4.0 | 12.9 | 2.6 | 3.0 |
| barrel result | circumferential speed | m/min | | 7.8 | 2.6 | 7.8 | 7.8 | 7.8 | 7.8 | 15.5 | 7.8 | 7.8 |
| | residual thickness of Sn component | μm | 0.1 or less (0.05 or less) | 0.01 | 0.04 | 0.03 | 0.01 | 0.03 | 0.04 | 0.01 | 0.01 | 0.02 |

| | | | | range of present invention | present invention example | | | | | | |
|---|---|---|---|---|---|---|---|---|---|---|---|
| | | | | | 10 | 11 | 12 | 13 | 14 | 15 | 16 |
| Cu-based material | material kind | | | | C2600 | C2600 | C2600 | C2600 | C2600 | C2600 | C2600 |
| | volume density | $g/cm^3$ | | | 1.2 | 1.2 | 1.2 | 1.2 | 1.2 | 1.2 | 1.2 |
| | plate thickness | mm | | | 0.25 | 0.25 | 0.25 | 0.25 | 0.25 | 0.25 | 0.25 |
| | mass | g | | | 2000 | 2000 | 2000 | 2000 | 500 | 2000 | 2000 |
| | Sn surface area | $dm^2$ | | | 180 | 180 | 180 | 180 | 45 | 180 | 180 |
| | Sn plating thickness | μm | 5 or less | | 1 | 1 | 1 | 1 | 1 | 1 | 1 |
| | Sn mass | g | | | 13.1 | 13.1 | 13.1 | 13.1 | 3.3 | 13.1 | 13.1 |
| | Sn mol number | mol | | | 0.11 | 0.11 | 0.11 | 0.11 | 0.03 | 0.11 | 0.11 |
| | pure Sn layer thickness | μm | | | 0.75 | 0.75 | 0.75 | 0.75 | 0.75 | 0.75 | 0.75 |
| | C: Sn mol number in pure Sn layer | mol | | | 0.08 | 0.08 | 0.08 | 0.08 | 0.02 | 0.08 | 0.08 |
| | D: Sn mol number in CuSn layer | mol | | | 0.03 | 0.03 | 0.03 | 0.03 | 0.01 | 0.03 | 0.03 |
| | required $H_2O_2$ mol number | mol | C × 2 + D × 6 | | 0.33 | 0.33 | 0.33 | 0.33 | 0.08 | 0.33 | 0.33 |
| alkali solution | kind | | | | NaOH | NaOH | NaOH | NaOH | NaOH | NaOH | KOH |
| | concentration | mass % | 3.0-37.5(3.5-30) | | 15.0 | 3.5 | 20.0 | 20.0 | 15.0 | 20.0 | 20.0 |
| | solution mass | g | | | 4800 | 7200 | 4800 | 7200 | 4800 | 4800 | 4800 |
| | A: alkali mol number | mol | | | 18 | 6.3 | 24 | 36 | 18 | 24 | 17.143 |
| | temperature | ° C. | 60-105(70-100) | | 90 | 90 | 90 | 90 | 90 | 90 | 90 |
| $H_2O_2$ solution | concentration | mass % | 3.0-50.0(3-35) | | 3 | 20 | 5 | 18 | 20 | 20 | 20 |
| | solution amount | g | | | 240 | 40 | 200 | 40 | 40 | 40 | 40 |
| | solution mass increase rate | % | (10 or less (5 or less)) | | 5.0 | 0.6 | 4.2 | 0.6 | 0.8 | 0.8 | 0.8 |
| | $H_2O_2$ mass | g | | | 7.2 | 8 | 10 | 7.2 | 8 | 8 | 8 |
| | B: $H_2O_2$ mol number | mol | ≧C × 2 + D × 6 | | 0.40 | 0.44 | 0.56 | 0.40 | 0.44 | 0.44 | 0.44 |
| | addition position | | in solution | | in solution | in solution | in solution | in solution | in solution | in solution | in solution |
| | addition speed | g/min | | | 12.0 | 2.0 | 10.0 | 2.0 | 4.0 | 1.3 | 1.3 |
| | addition time | min | 5-60 | | 20 | 20 | 20 | 20 | 10 | 30 | 30 |
| | holding time after addition | min | | | 0 | 0 | 0 | 0 | 0 | 0 | 0 |
| mol ratio | alkali/Sn | | 50 or more | | 163 | 57 | 217 | 326 | 651 | 217 | 155 |
| | A/B: alkali/$H_2O_2$ | | 10 or more | | 45.0 | 14.2 | 43.2 | 90.0 | 40.5 | 54.0 | 38.6 |
| | $H_2O_2$/Sn | | | | 3.6 | 4.0 | 5.0 | 3.6 | 16.1 | 4.0 | 4.0 |
| barrel result | circumferential speed | m/min | | | 7.8 | 7.8 | 7.8 | 5.2 | 7.8 | 7.8 | 7.8 |
| | residual thickness of Sn component | μm | 0.1 or less (0.05 or less) | | 0.01 | 0.03 | 0.01 | 0.03 | 0.00 | 0.00 | 0.06 |

TABLE 2

| | | | range of present invention | comparative example 1 | 2 | 3 | 4 |
|---|---|---|---|---|---|---|---|
| Cu-based material | material kind | | | C2600 | C2600 | C2600 | C2600 |
| | volume density | g/cm$^3$ | | 1.2 | 1.2 | 1.2 | 1.2 |
| | plate thickness | mm | | 0.25 | 0.25 | 0.25 | 0.25 |
| | mass | g | | 2000 | 2000 | 2000 | 2000 |
| | Sn surface area | dm$^2$ | | 180 | 180 | 180 | 180 |
| | Sn plating thickness | μm | 5 or less | 1 | 1 | 1 | 1 |
| | Sn mass | g | | 13.1 | 13.1 | 13.1 | 13.1 |
| | Sn mol number | mol | | 0.11 | 0.11 | 0.11 | 0.11 |
| | pure Sn layer thickness | μm | | 0.75 | 0.75 | 0.75 | 0.75 |
| | C: Sn mol number in pure Sn layer | mol | | 0.08 | 0.08 | 0.08 | 0.08 |
| | D: Sn mol number in CuSn layer | mol | | 0.03 | 0.03 | 0.03 | 0.03 |
| | required $H_2O_2$ mol number | mol | C × 2 + D × 6 | 0.33 | 0.33 | 0.33 | 0.33 |
| alkali solution | kind | | | NaOH | NaOH | NaOH | NaOH |
| | concentration | mass % | 3.0-37.5(3.5-30) | 20.0 | 48.0 | 15.0 | 20.0 |
| | solution mass | g | | 4800 | 4800 | 1000 | 4800 |
| | A: alkali mol number | mol | | 24 | 57.6 | 3.75 | 24 |
| | temperature | ° C. | 60-105(70-100) | 90 | 90 | 90 | 50 |
| $H_2O_2$ solution | concentration | mass % | 3.0-50.0(3-35) | 20 | 20 | 20 | 20 |
| | solution amount | g | | 40 | 40 | 40 | 40 |
| | solution mass increase rate | % | (10 or less (5 or less)) | 0.8 | 0.8 | 4.0 | 0.8 |
| | $H_2O_2$ mass | g | | 8 | 8 | 8 | 8 |
| | B: $H_2O_2$ mol number | mol | ≧C × 2 + D × 6 | 0.44 | 0.44 | 0.44 | 0.44 |
| | addition position | | in solution | dripping | in solution | in solution | in solution |
| | addition speed | g/min | | 2.0 | 2.0 | 2.0 | 2.0 |
| | addition time | min | 5-60 | 20 | 20 | 20 | 20 |
| | holding time after addition | min | | 0 | 0 | 0 | 0 |
| mol ratio | alkali/Sn | | 50 or more | 217 | 521 | 34 | 217 |
| | A/B: alkali/$H_2O_2$ | | 10 or more | 54.0 | 129.6 | 8.4 | 54.0 |
| | $H_2O_2$/Sn | | | 4.0 | 4.0 | 4.0 | 4.0 |
| barrel result | circumferential speed | m/min | | 7.8 | 7.8 | 7.8 | 7.8 |
| | residual thickness of Sn component | μm | 0.1 or less (0.05 or less) | 0.17 | 0.13 | 0.11 | 0.14 |

| | | | range of present invention | comparative example 5 | 6 | 7 |
|---|---|---|---|---|---|---|
| Cu-based material | material kind | | | C2600 | C2600 | C2600 |
| | volume density | g/cm$^3$ | | 1.2 | 1.2 | 1.2 |
| | plate thickness | mm | | 0.25 | 0.25 | 0.25 |
| | mass | g | | 2000 | 2000 | 2000 |
| | Sn surface area | dm$^2$ | | 180 | 180 | 180 |
| | Sn plating thickness | μm | 5 or less | 1 | 1 | 1 |
| | Sn mass | g | | 13.1 | 13.1 | 13.1 |
| | Sn mol number | mol | | 0.11 | 0.11 | 0.11 |
| | pure Sn layer thickness | μm | | 0.75 | 0.75 | 0.75 |
| | C: Sn mol number in pure Sn layer | mol | | 0.08 | 0.08 | 0.08 |
| | D: Sn mol number in CuSn layer | mol | | 0.03 | 0.03 | 0.03 |
| | required $H_2O_2$ mol number | mol | C × 2 + D × 6 | 0.33 | 0.33 | 0.33 |
| alkali solution | kind | | | NaOH | NaOH | NaOH |
| | concentration | mass % | 3.0-37.5(3.5-30) | 20.0 | 2.4 | 20.0 |
| | solution mass | g | | 4800 | 4800 | 4800 |
| | A: alkali mol number | mol | | 24 | 2.88 | 24 |
| | temperature | ° C. | 60-105(70-100) | 90 | 90 | 90 |
| $H_2O_2$ solution | concentration | mass % | 3.0-50.0(3-35) | 1 | 20 | 20 |
| | solution amount | g | | 600 | 40 | 20 |
| | solution mass increase rate | % | (10 or less (5 or less)) | 12.5 | 0.8 | 0.4 |
| | $H_2O_2$ mass | g | | 6 | 8 | 4 |
| | B: $H_2O_2$ mol number | mol | ≧C × 2 + D × 6 | 0.33 | 0.44 | 0.22 |
| | addition position | | in solution | in solution | in solution | in solution |
| | addition speed | g/min | | 30.0 | 2.0 | 1.0 |
| | addition time | min | 5-60 | 20 | 20 | 20 |
| | holding time after addition | min | | 0 | 0 | 0 |

TABLE 2-continued

| | | | | | | |
|---|---|---|---|---|---|---|
| mol | alkali/Sn | | 50 or more | 217 | 26 | 217 |
| ratio | A/B: alkali/$H_2O_2$ | | 10 or more | 72.0 | 6.5 | 108.0 |
| | $H_2O_2$/Sn | | | 3.0 | 4.0 | 2.0 |
| barrel | circumferential speed | m/min | | 7.8 | 7.8 | 7.8 |
| result | residual thickness of Sn component | μm | 0.1 or less (0.05 or less) | 0.09 | 0.19 | 0.12 |

What is claimed is:

1. A method of detinning a Sn plating layer on a Cu-based material for recycling the Cu-based material on which the Sn plating layer including a Sn layer and/or a CuSn layer is formed, said method comprising:

immersing the Cu-based material into an alkali hydroxide solution with a concentration of 3.0 to 37.5 mass % and adding a $H_2O_2$ solution with a concentration of 3.0 to 50.0 mass % in the alkali hydroxide solution, wherein a temperature of the alkali hydroxide solution when the Cu-based material is immersed ranges from 60 to 105° C., wherein a ratio A/B between a mol number A of alkali hydroxide in the alkali hydroxide solution and a mol number B of $H_2O_2$ in the $H_2O_2$ solution is 10 or more, and wherein where a mol number of Sn in the Sn layer is C and a mol number of Sn in the CuSn layer is D, $B \geqq C \times 2 + D \times 6$.

2. The method of detinning a Sn plating layer on a Cu-based material according to claim 1, wherein the alkali hydroxide solution is a NaOH or KOH solution.

3. The method of detinning a Sn plating layer on a Cu-based material according to claim 1, wherein the $H_2O_2$ solution is added from a bottom of the alkali hydroxide solution.

4. The method of detinning a Sn plating layer on a Cu-based material according to claim 1, wherein the $H_2O_2$ solution is added while stirring the alkali hydroxide solution.

5. The method of detinning a Sn plating layer on a Cu-based material according to claim 1, wherein after a predetermined amount of the $H_2O_2$ solution is continuously added to the alkali hydroxide solution, the continuous addition of the $H_2O_2$ solution is stopped and the Cu-based material is immersed and kept in the alkali hydroxide solution for one hour or less.

6. The method of detinning a Sn plating layer on a Cu-based material according to claim 1, wherein a concentration of sodium carbonate in the alkali hydroxide solution is 20 mass % or less.

7. The method of detinning a Sn plating layer on a Cu-based material according to claim 1, wherein the Cu-based material to which the Sn plating has been applied is a Cu-based material to which machining oil due to a cutting process or a pressing process has adhered.

8. The method of detinning a Sn plating layer on a Cu-based material according to claim 1, wherein a thickness of the Sn plating on the Cu-based material is 5 μm or less.

9. The method of detinning a Sn plating layer on a Cu-based material according to claim 1, wherein a thickness of the CuSn layer is 0.2 to 2 μm.

10. The method of detinning a Sn plating layer on a Cu-based material according to claim 1, wherein a time of continuously adding the $H_2O_2$ solution is 5 to 60 minutes.

* * * * *